US005159691A

United States Patent [19]

Fujita

[11] Patent Number: 5,159,691

[45] Date of Patent: Oct. 27, 1992

[54] MASTER AND SLAVE CPU SYSTEM WHERE THE SLAVE CHANGES STATUS BITS OF A CENTROL TABLE WHEN MODES ARE CHANGED

[75] Inventor: Hiroshi Fujita, Nara, Japan

[73] Assignee: Sharp Kabushiki Kaisha, Osaka, Japan

[21] Appl. No.: 804,510

[22] Filed: Dec. 10, 1991

Related U.S. Application Data

[63] Continuation of Ser. No. 319,667, Mar. 7, 1989, abandoned.

[30] Foreign Application Priority Data

Mar. 7, 1988 [JP] Japan ..... 63-53016

[51] Int. Cl.[5] ..... G06F 13/10

[52] U.S. Cl. ..... 395/800; 364/931.44; 364/228.6; 364/DIG. 2

[58] Field of Search ..... 364/DIG. 1 MS FILE, 364/DIG. 3 MS File; 395/800, 200, 650; 355/204, 205, 206, 207, 208

[56] References Cited

U.S. PATENT DOCUMENTS 4,633,405 12/1986 Ito et al. ..... 364/184

4,811,052 3/1989 Yamakawa et al. ..... 355/14 C

*Primary Examiner*—Thomas C. Lee

*Assistant Examiner*—Robert B. Harrell

[57] ABSTRACT

A master slave CPU system comprises a resetting device for resetting the control conditions of all of the control objects coupled to the respective slave CPUs and a setting device for sending to the slave CPUs set signal or set signals of only the control objects which are to be enabled when the control mode is changed.

2 Claims, 6 Drawing Sheets

MASTER AND SLAVE CPU SYSTEM WHERE THE SLAVE CHANGES STATUS BITS OF A CENTROL TABLE WHEN MODES ARE CHANGED

This application is a continuation of application Ser. No. 07/319,667 filed on Mar. 7, 1989, now abandoned.

BACKGROUND OF THE INVENTION

1. Field of the Invention

The present invention relates to a multi processing system composed of more than two data processing units such as a master and slave CPU system having one master, CPU and more than two slave CPU which are arranged in a hierarchial structure.

2. Description of the Prior Arts

In an apparatus having a plurality of control objects such as input devices and output devices, it is well known to divide the apparatus into a number sections and to provide a master control unit and a plurality of sub control units so that each sub control unit controls independently any one of the sections assigned to the respective sub control unit under the supervision by the master control unit. The arrangement mentioned above enables to decreases the burden of the respective sub control units and improves improve the reliability of the control system. If the sub control units are simple, there is provided a condition control table for each sub control units in the master control unit and each sub control units cannot control the corresponding control object or objects so as to realize the data sent directly from the master control unit.

In a master and slave CPU system as mentioned above, in the apparatus in which with several control modes and where the combinations of control objects to be operated on are different for each control modes, it is necessary to update the contents of the condition control table at the time of changing of the control mode and it is necessary to send signals to the sub control units so as to enable only the control objects designated in the new mode. In a conventional master slave CPU system, the previous control conditions of all of the control objects are compared with the current conditions which are used in the newly selected control modes and the master CPU sends a keeping signal instructing the slave CPUs to keep the present control condition control conditions when the of the comparison coincide and sends a reversing signal instructing the slave CPUs to update when the control condition of the previous control mode is different from that of the current condition.

However, in the conventional master slave CPU system, if once the control mode is changed, after all of the control conditions of the previous control mode are compared with all of those of the current control conditions, and the master CPU send the keeping signal or reversing signal to the slave CPUs with respect to all of the control objects, whereby the control processing in the master control CPU is redundant and a long time is consumed.

SUMMARY OF THE INVENTION

An essential object of the present invention is to provide a master and slave CPU system in which the time to change control modes in the control apparatus is shortened.

In order to accomplish the object of the present invention, a master and slave CPU system comprises a resetting device for resetting the control conditions of all of the control objects coupled to the respective slave CPUs and a setting device for sending to the slave CPUs a set signal or set signals containing only the control objects which are to be enabled when the control mode is changed.

In the arrangement of the present invention, when the control mode is changed, the conditions of all control objects are reset by the resetting device. After the reset is finished, the set signals are sent to only the control objects to be enabled in the control mode after the control mode is changed. Accordingly, there is no need to compare the control conditions of the previous control mode with the control conditions in the current control mode. Further, there is no need to generate the control signals for the control objects which are to be disabled in the current control mode, thereby simplifying the processing of the master CPU in changing the control mode.

DETAILED DESCRIPTION OF THE PREFERRED EMBODIMENT

Figure 1:
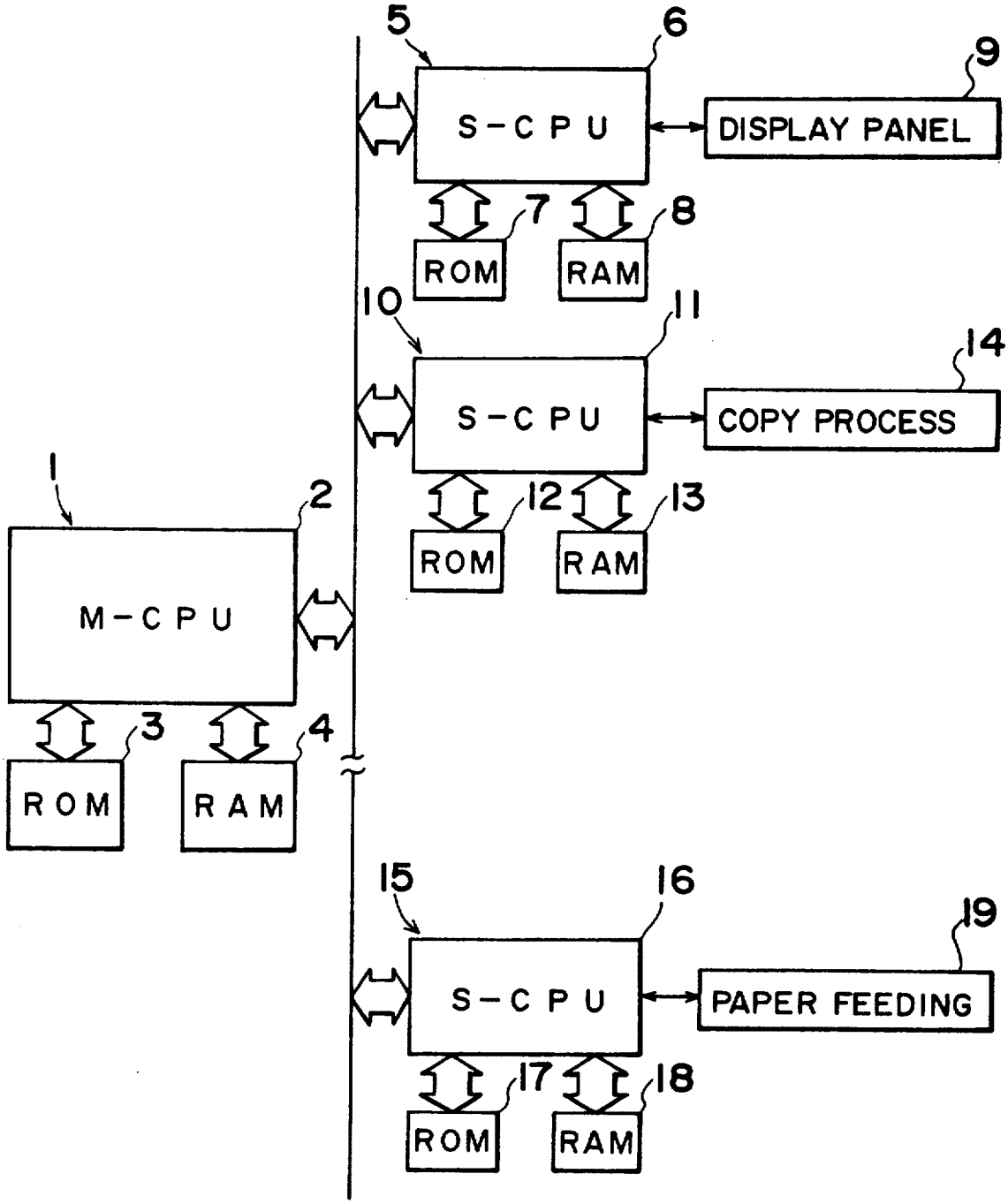
FIG. 1 is a block diagram showing an embodiment of a copying machine into which the master slave CPU system according to the present invention has been incorporated.

Referring to FIG. 1, a main control unit 1 is composed of a master CPU (central processing unit) 2 depicted as M-CPU in the drawings), a ROM (read only memory) 3 and a RAM (random access memory) 4 connected to the master CPU 2. The master CPU 2 is connected with various sub control units containing a display panel control unit 5, a copying process control unit 10 and a paper feeding control unit 15 through an internal bus 20. The display panel control unit 5 comprises a slave CPU (depicted as S-CPU in the drawings) 6, a ROM 7 and a RAM 8 connected to the slave CPU 6. The copying process control unit 10 comprises a slave CPU 11, a ROM 12 and a RAM 13 connected to the slave CPU 11. The paper feeding control unit 15 comprises a slave CPU 16, a ROM 17 and a RAM 18 connected to the slave CPU 16.

The structure and operation of the master slave CPU system according to the present invention are described in detail with respect to the relation of the main control unit 1 and the display panel control unit 5 for example.

Figure 2:
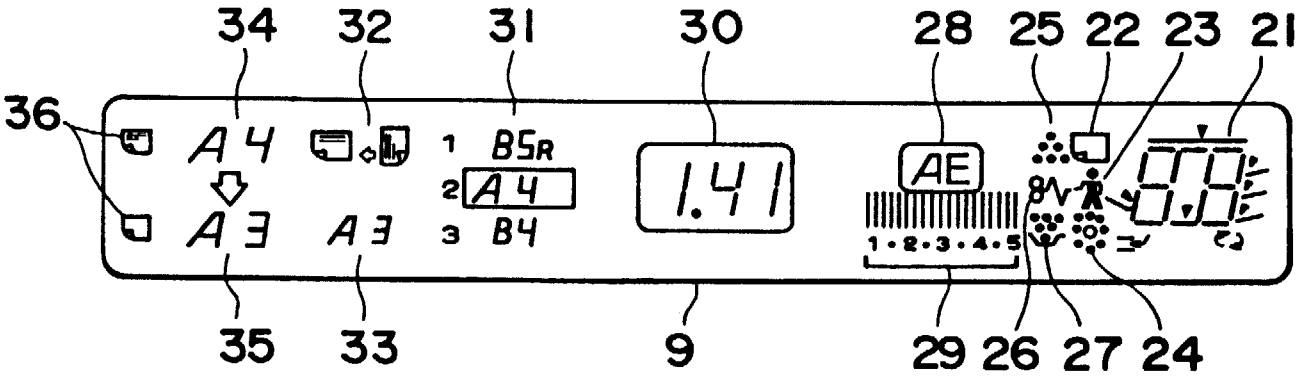
FIG. 2 is a top plan view of a display panel of the copying machine shown in FIG. 1.

FIG. 2 is a plan view of a display panel 9 which is connected to the slave CPU 6 of the display panel control unit 5.

On the display panel 9, there are disposed a copy number display unit 21 for displaying various numerals such as copying number which is entered from numeric keys (not shown) from 0 to 9 (so called ten keys), a paper supply lamp 22 for displaying a fact that the copying papers are supplied when the copying paper is absent, a maintenance lamp 23 for displaying a request of maintenance by a service man, a developer exchange lamp 24 for promoting exchange of the developing unit, a toner supply lamp 25 for promoting supply of the toner, a paper jam display lamp 26 for displaying occurrence of paper jam, a toner recovery lamp 27 for displaying a fact that waste toner is full, an automatic exposure display lamp 28 for displaying when an automatic exposure mode is selected, an exposure scale lamp 29 for displaying a set condition of the exposure value under the automatic exposure control mode, a magnification display unit 30 for displaying the set copy magnification value, a paper size display lamp 31 for displaying a selected paper size, an original set direction display lamp 32 for requesting change of the direction of an original put on a original platform of the copying machine, a designated cassette display lamp 33 for displaying a size of paper of the necessary paper cassette which is not mounted to the copying machine, an original size display lamp 34 for displaying the size of the original which is detected by a paper size detecting sensor (not shown) provided in the copying machine, a designated size display lamp 35 for displaying the paper size designated by an operator and a paper/magnification selection display lamp 36 for displaying that paper/magnification mode is set. The paper/magnification mode is a mode for automatically setting the paper size or copy magnification value corresponding to the selected paper size or copy magnification value.

The master CPU 2 in the main control unit 1 generates to the slave CPU 6 a driving signal or driving signals for driving any one or more display lamps and/or display unit in the display lamps 21 to 36 and display unit 30 disposed on the display panel 9 which are required to be driven in the mode which is currently performed according to the program written in the ROM 3. The slave CPU 6 of the display panel control unit 5 drives the various display lamps and display unit according to the drive signals mentioned above.

Figure 3:
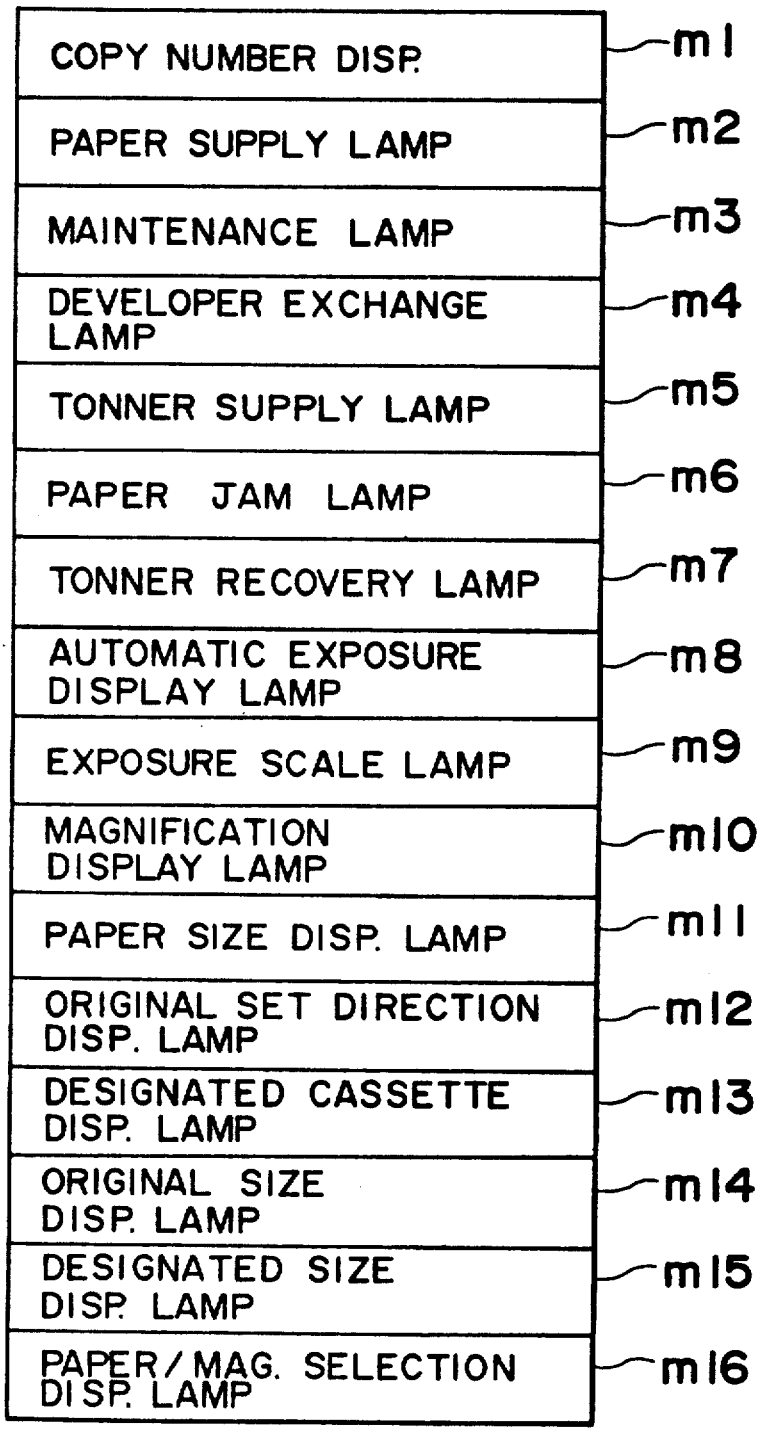
FIG. 3 is a schematic diagram showing a memory map of an essential portion of a RAM composing a part of a display panel control unit of the copying machine shown in FIG. 1.

FIG. 3 is a memory map of the essential portion of the RAM 8 of the display panel control unit 5.

The memory areas m1 to m16 of the RAM 8 connected to the slave CPU 6 of the display panel control unit 5 are assigned as flags for storing the operation conditions of the respective copy number display unit 21, paper supply lamp 22, maintenance lamp 23, developer exchange lamp 24, toner supply lamp 25, paper jam lamp 26, toner recovery lamp 27, automatic exposure display lamp 28, exposure scale lamp 29, magnification display unit 30, paper size display lamp 31, original set direction display lamp 31, original set direction display lamp 32, designated cassette display lamp 33, original size display lamp 34, designated size display lamp 35 and paper/magnification display lamp 36. The slave CPU 6 sets any of the flags of the display lamps and display unit to be driven to "1" according to the contents of the driving data fed from the master CPU 2. Thereafter, the slave CPU 6 drives the required lamps and display unit according to the program stored in the ROM 7 and the condition of the flags stored in the RAM 8.

Figure 4:
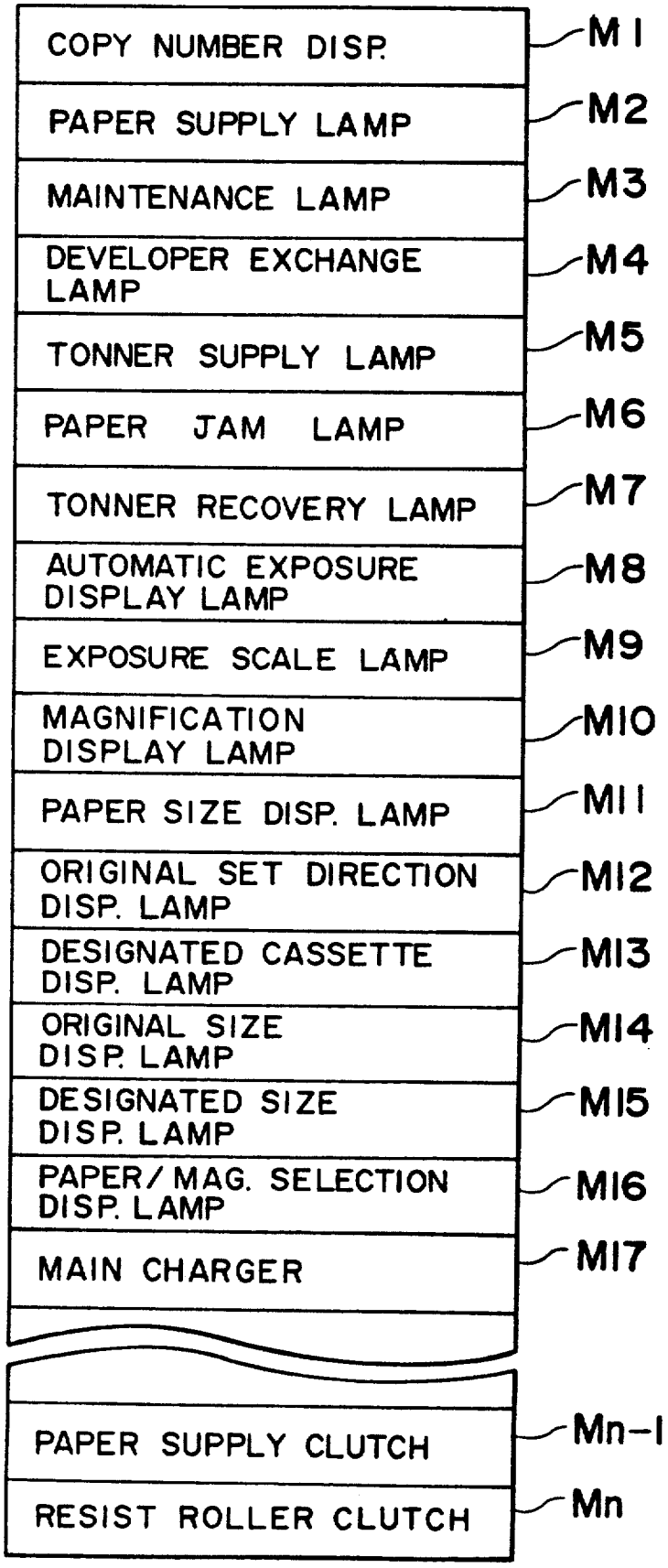
FIG. 4 is a schematic diagram showing a memory map of an essential portion of another RAM composing a part of a master control unit used in the copying machine.

FIG. 4 is a memory map of the essential portion of the RAM constituting a part of the main control unit.

The memory areas M1 to Mn of the RAM 4 connected to the master CPU 2 of the main control unit 1 are assigned as the flags for storing the operating conditions of the control objects connected to all of the sub control units such as display panel control unit 5, copy processing control unit 10 and so on. Namely, flags equivalent to the flags assigned in the memory areas of the parts of the RAM 8, RAM 13 and so on, are assigned in the memory areas M1 to Mn which act as a condition control table. In the condition control table, the areas M1 to M16 are memory areas for the display panel control unit 5 and are assigned to the respective display unit and lamps in the same manner as those in the memory areas m1 to m16 of the RAM 8 shown in FIG. 3.

Figure 5:
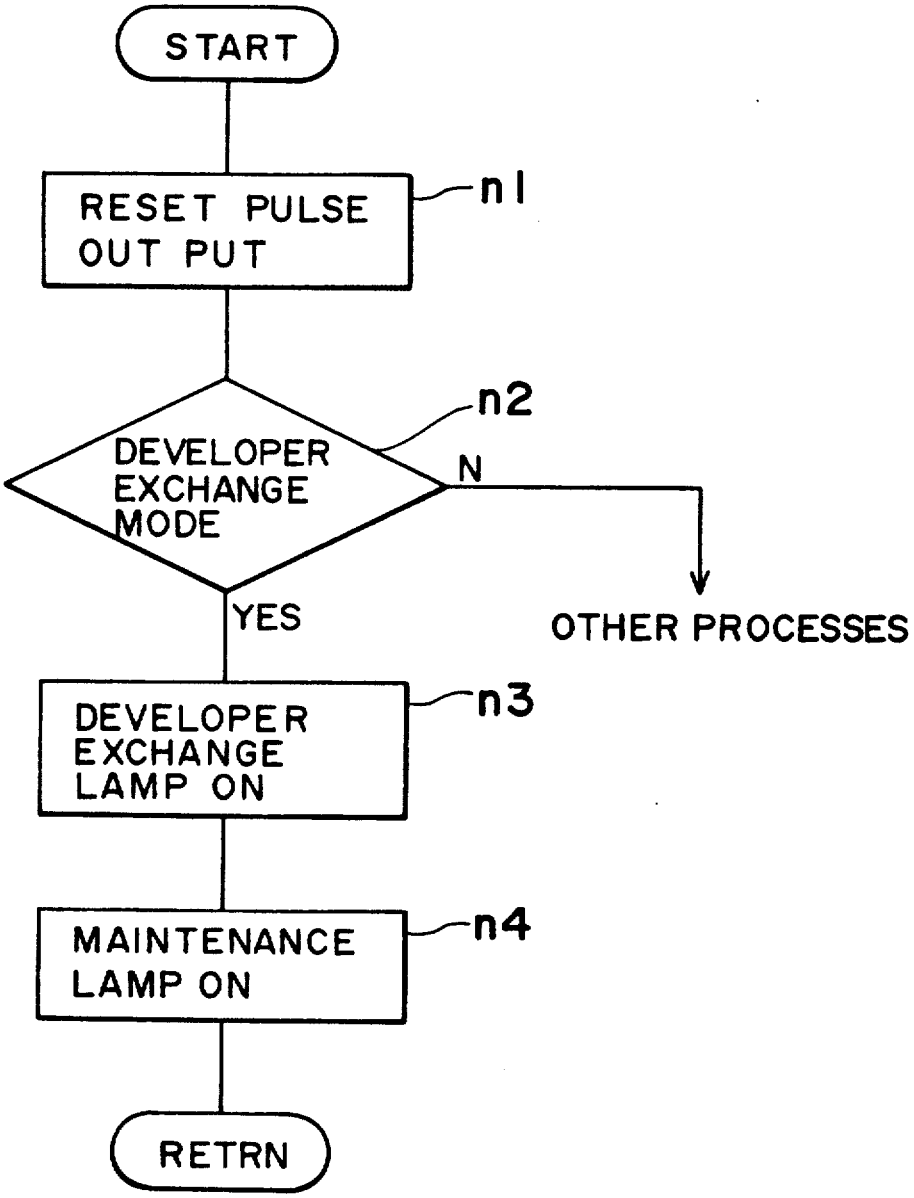
FIG. 5 is a flow chart showing a part of processing of a main control unit used in the copying machine, and FIGS. 6 (A) 6(B) and 6(C) are memory maps showing the change of conditions stored in the RAM composing a part of the display panel control unit at the time of changing of the control mode.

FIG. 5 is a flow chart showing the process in the maintenance mode for replacing the developer in the main control unit.

When the developer mounted in the copying machine wears during the copy process mode and replacement of the developer by a serviceman is required, the control mode is changed to the maintenance mode for replacing the developer. In the mode change, the interruption processing as shown in FIG. 5 is performed. First, reset pulses are generated to all of the sub control units from the main control unit 1 in the step n1. Then, the flags assigned in the memory areas in the RAMs 8, 13 and 18 and so on are reset to "0". At this time, the flags assigned to the memory areas M1 to Mn in the RAM 4 are reset to "0". Thereafter, the new control mode is detected and if the new mode is the maintenance mode for the developer replacement, the master CPU 2 generates the driving data of the developer exchange lamp 24 and maintenance lamp 23 in the steps n3 and n4.

Figure 6:
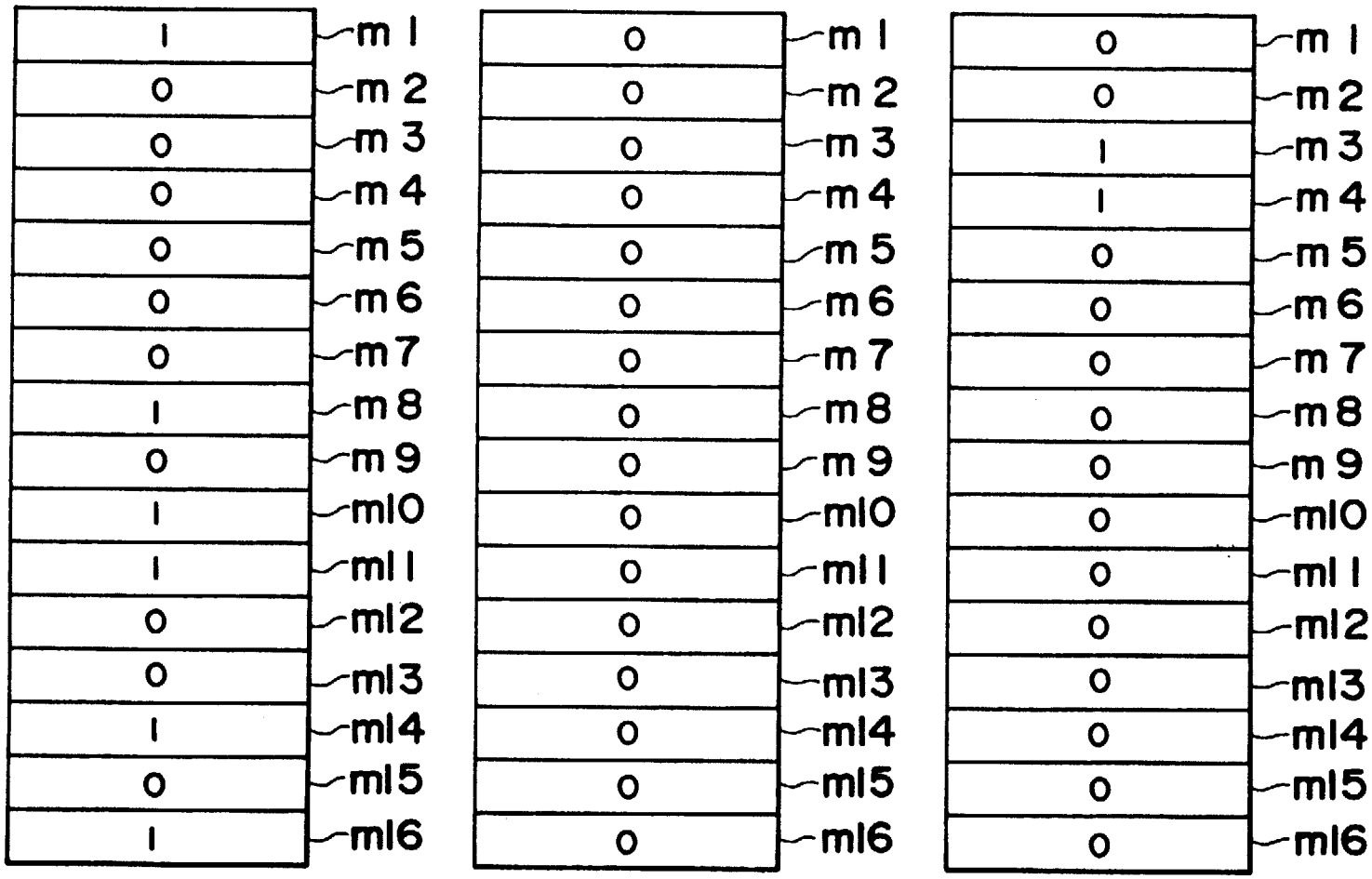

As mentioned above, in the normal copy process mode the memory areas ml to m16 of the RAM 8 of the display panel control unit 5 are set to the conditions shown in FIG. 6 (A), and the copy number display unit 21, automatic exposure display lamp 28, magnification display unit 30, paper size display lamp 31, original size display lamp 34 and paper/magnification selection display lamp 36 are respectively turned on at the display panel 9. When the mode is changed in the condition mentioned above, the condition of the memory areas ml to m16 are once reset to "0" as shown in FIG. 6(B) by generation of the reset pulses. Thereafter, by generation of the driving data of the developer exchange lamp 24 required in the maintenance mode for the developer exchange and maintenance lamp 23, only the memory area m3 and the memory area m4 are set to "1" as shown in FIG. 6(C).

In the process mentioned above the step n1 corresponds to the reset means and the steps n3 and n4 correspond to the set means. The processes mentioned above are performed in the sub control units such as the copy process control unit 10 and/or paper feeding control unit 15. Case where the control mode is changed the resetting and setting of the memory areas are performed in a similar manner as mentioned above, whereby only the required one or more input devices and output devices are driven according to the conditions stored in the corresponding RAMs.

As mentioned above according to the present embodiment when the conditions of the control objects are changed in the mode changing period, once reset pulses are generated from the main CPU 1 so that all of the control objects are stopped and thereafter the driving data for only the control objects to be driven in the new control mode. Therefore, the procedures to be performed by the master CPU 2 is simplified compared to the conventional procedure in which the respective conditions of the flags in the memory areas of the RAM of the main control unit are compared with the conditions of the new mode so that the present control conditions are respectively judged and the master CPU generates the keeping signals for the correct conditions and reversing signals for the incorrect conditions. Therefore the load bearing on the master CPU can be decreased.

Although the present invention is explained with reference to a copying apparatus as an embodiment, the present invention can be applied to various control apparatus having a number of input devices and output devices which are separated into a plurality of groups.

What is claimed is:

1. A master and slave CPU system, comprising:

master CPU means for receiving a first control mode and generating a first driving signal; and a plurality of slave CPU means for receiving the first driving signal, each of the plurality of slave CPU means setting a plurality of flags in a respective condition control table, indicating operating conditions for each of the plurality of slave CPU means in the first control mode, and driving a plurality of control objects, connected to each of the plurality of slave CPU means, in accordance with the operating conditions of the first control mode;

said master CPU means further receiving a second control mode and generating a reset signal and a second driving signal;

each of said plurality of salve CPU means further receiving the reset signal, resetting the plurality of flags in the respective condition control table, thereby clearing the operating conditions of the first control mode, receiving the second driving signal, setting the plurality of flags in the respective condition control table indicating operating conditions for each of the plurality of slave CPU means in the second control mode and driving the plurality of control objects, connected to each of the plurality of slave CPU means, in accordation with the operating conditions of the second control mode, thereby minimizing processing required by said master CPU means.

2. A method of minimizing processing of a master CPU in a master and slave CPU system, during a change in a control mode of said master and slave CPU system, said method comprising the steps of:

(a) receiving a first control mode and generating a first driving signal by the master CPU;

(b) setting a plurality of flags in a condition control table for each of a plurality of slave CPUs indicating operating conditions for each of the plurality of slave CPUs in the first control mode in accordance with the first driving signal, by the plurality of slave CPUs, thereby minimizing the processing of the master CPU;

(c) driving a plurality of control objects, connected to each of the plurality of slave CPUs in accordance with the operating conditions of the first control mode by the plurality of slave CPUs;

(d) receiving a second control mode and generating a reset signal and a second driving signal by the master CPU;

(e) clearing the plurality of flags in the condition control table for each of the plurality of salve CPUs in accordance with the reset signal, thereby clearing the operating conditions of the first control mode by the plurality of slave CPUs, thereby minimizing processing of the master CPU;

(f) setting the plurality of flags in the condition control table for each of the plurality of slave CPUs indicating operating conditions for each of the plurality of slave CPUs in the second control mode in accordance wtih the second driving signal, by the plurality of slave CPUs, thereby minimizing processing of the master CPU; and (g) driving the plurality of control objects in accordance with the operating conditions of the second control mode by the plurality of slave CPUs.

* * * * *

UNITED STATES PATENT AND TRADEMARK OFFICE

CERTIFICATE OF CORRECTION

PATENT NO. : 5,159,691

DATED : October 27, 1992

INVENTOR(S) : Hiroshi FUJITA

It is certified that error appears in the above-identified patent and that said Letters Patent is hereby corrected as shown below:

On the Title page, item [54], line 3, and col. 1, line 2,
Change "CENTROL" to --CONTROL--.

Signed and Sealed this

Fifth Day of April, 1994

Bruce Lehman

*Attest:*

BRUCE LEHMAN

*Attesting Officer*

*Commissioner of Patents and Trademarks*